US008974267B2

(12) United States Patent
Pietsch et al.

(10) Patent No.: US 8,974,267 B2
(45) Date of Patent: Mar. 10, 2015

(54) INSERT CARRIER AND METHOD FOR THE SIMULTANEOUS DOUBLE-SIDE MATERIAL-REMOVING PROCESSING OF SEMICONDUCTOR WAFERS

(75) Inventors: Georg Pietsch, Burghausen (DE); Michael Kerstan, Burghausen (DE)

(73) Assignee: Siltronic AG, Munich (DE)

( * ) Notice: Subject to any disclaimer, the term of this patent is extended or adjusted under 35 U.S.C. 154(b) by 537 days.

(21) Appl. No.: 13/311,575

(22) Filed: Dec. 6, 2011

(65) Prior Publication Data

US 2012/0190277 A1 Jul. 26, 2012

(30) Foreign Application Priority Data

Jan. 21, 2011 (DE) ..... 10 2011 003 008

(51) Int. Cl.
*B24B 1/00* (2006.01)
*B24B 37/28* (2012.01)

(52) U.S. Cl.
CPC ..... *B24B 37/28* (2013.01)
USPC ..... 451/41; 451/63; 451/269; 451/398

(58) Field of Classification Search
CPC ..... B24B 7/17; B24B 7/228; B24B 7/08; B24B 7/28; B24B 37/27; B24B 37/28
USPC ..... 451/41, 63, 260–262, 268–271, 397, 451/398, 400
See application file for complete search history.

(56) References Cited

U.S. PATENT DOCUMENTS

| | | | | |
|---|---|---|---|---|
| 5,441,442 | A * | 8/1995 | Haisma et al. | 451/63 |
| 6,042,688 | A | 3/2000 | Masumura et al. | |
| 6,113,478 | A * | 9/2000 | Anderson et al. | 451/262 |
| 6,582,279 | B1 * | 6/2003 | Fox et al. | 451/37 |
| 7,589,023 | B2 * | 9/2009 | Taniguchi et al. | 451/285 |
| 8,137,157 | B2 * | 3/2012 | Fletcher et al. | 451/41 |
| 2001/0047978 | A1 | 12/2001 | Wenski et al. | |
| 2008/0233840 | A1 | 9/2008 | Pietsch et al. | |

(Continued)

FOREIGN PATENT DOCUMENTS

| | | |
|---|---|---|
| DE | 19937784 A1 | 2/2001 |
| DE | 10250823 B4 | 2/2005 |

(Continued)

OTHER PUBLICATIONS

P. Beyer et al., Industrie Diamanten Rundschau, IDR 39 (2005) III, p. 202-207.

(Continued)

*Primary Examiner* — Maurina Rachuba
(74) *Attorney, Agent, or Firm* — Leydig, Voit & Mayer, Ltd.

(57) ABSTRACT

An insert carrier is configured to receive at least one semiconductor wafer for double-side processing of the wafer between two working disks of a lapping, grinding or polishing process. The insert carrier includes a core of a first material that has a first surface and a second surface, and at least one opening configured to receive a semiconductor wafer. A coating at least partially covers the first and second surfaces of the core. The coating includes a surface remote from the core that includes a structuring including elevations and depressions. A correlation length of the elevations and depressions is in a range of 0.5 mm to 25 mm and an aspect ratio of the structuring is in a range of 0.0004 to 0.4.

13 Claims, 5 Drawing Sheets

(56) References Cited

U.S. PATENT DOCUMENTS

| | | | | |
|---|---|---|---|---|
| 2009/0104852 | A1* | 4/2009 | Pietsch et al. | 451/41 |
| 2009/0311863 | A1 | 12/2009 | Hashii et al. | |

FOREIGN PATENT DOCUMENTS

| | | | |
|---|---|---|---|
| DE | 10023002 | B4 | 10/2006 |
| DE | 102007013058 | A1 | 9/2008 |
| WO | WO 2008064158 | A1 | 5/2008 |
| WO | 102007049811 | A1 | 4/2009 |
| WO | WO 2010078312 | A1 | 7/2010 |

OTHER PUBLICATIONS

T. Fletcher et al., Optifab 2005; Rochester NY, May 2, 2005, p. 1-3.

* cited by examiner

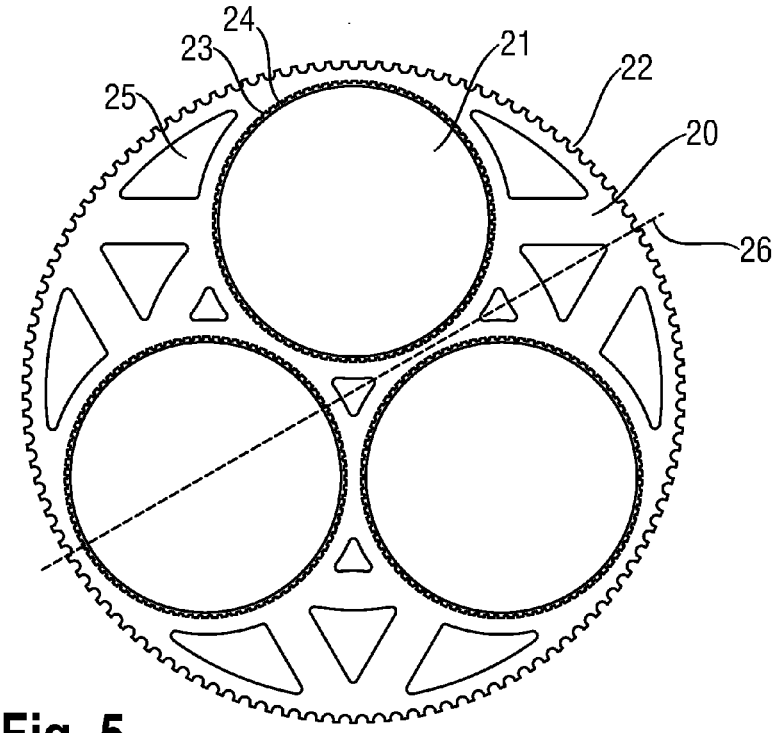
Fig. 5
Fig. 6A
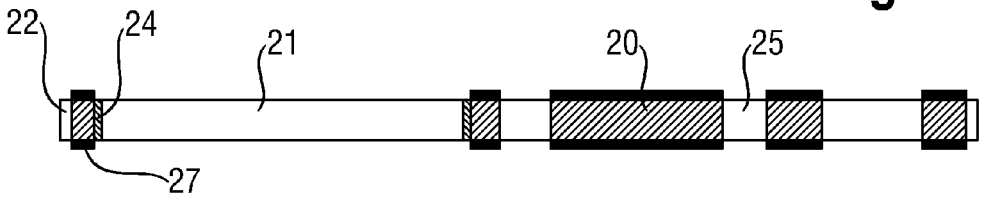
Fig. 6B
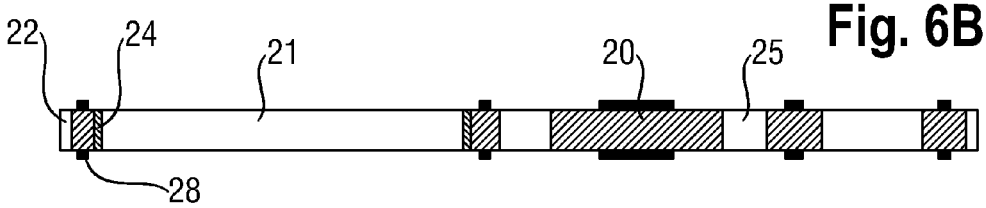
Fig. 6C
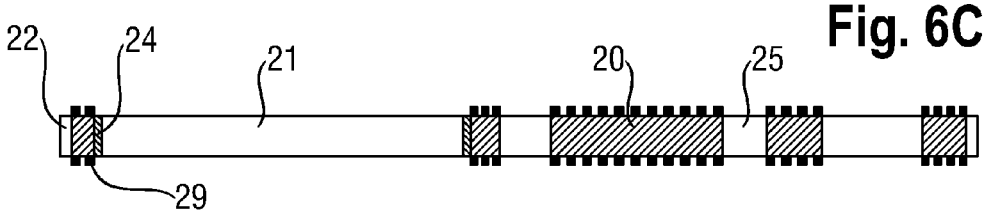

INSERT CARRIER AND METHOD FOR THE SIMULTANEOUS DOUBLE-SIDE MATERIAL-REMOVING PROCESSING OF SEMICONDUCTOR WAFERS

CROSS REFERENCE TO RELATED APPLICATIONS

This application claims priority to German Patent Application No. DE 10 2011 003 008.5, filed Jan. 21, 2011, which is hereby incorporated by reference herein in its entirety.

FIELD

The present invention relates to an insert carrier suitable for receiving one or a plurality of semiconductor wafers for the double-side processing thereof between two working disks of a lapping, grinding or polishing apparatus.

BACKGROUND

Electronics, microelectronics and microelectromechanics require as starting materials semiconductor wafers with extreme requirements made of global and local flatness, single-side-referenced flatness (nanotopology), roughness and cleanness. Semiconductor wafers are wafers composed of semiconductor materials such as elemental semiconductors (silicon, germanium), compound semiconductors (for example composed of an element of the third main group of the periodic table such as aluminum, gallium or indium and an element of the fifth main group of the periodic table such as nitrogen, phosphorus or arsenic) or the compounds thereof (for example $Si_{1-x}Ge_x$, $0<x<1$).

In accordance with the prior art, semiconductor wafers are produced by means of a multiplicity of successive process steps which can generally be classified into the following groups:

(a) producing a usually monocrystalline semiconductor rod;
(b) slicing the rod into individual wafers;
(c) mechanical processing;
(d) chemical processing;
(e) chemomechanical processing;
(f) if appropriate additional production of layer structures.

A method designated "planetary pad grinding" ("PPG", pad grinding with planetary kinematics) is known as a particularly advantageous method from the group of mechanical processing steps. The method is described for example in DE102007013058A1, and an apparatus suitable therefor is described for example in DE19937784A1. PPG is a method for the simultaneous double-side grinding of a plurality of semiconductor wafers, wherein each semiconductor wafer lies such that it is freely movable in a cutout in one of a plurality of running disks (insert carriers) caused to rotate by means of a rolling apparatus and is thereby moved on a cycloidal trajectory. The semiconductor wafers are processed in material-removing fashion between two rotating working disks. Each working disk comprises a working layer containing bonded abrasive. The working layers are present in the form of structured grinding pads which are fixed on the working disks adhesively, magnetically, in a positively locking manner (for example hook and loop fastener) or by means of vacuum.

A similar method is so-called "flat honing" or "fine grinding". In this case, a plurality of semiconductor wafers in the arrangement described above for PPG are guided on the characteristic cycloidal paths between two large rotating working disks by means of a rolling apparatus. Abrasive grain is fixedly bonded into the working disks, such that the material removal is effected by means of grinding. In the case of flat honing, the abrasive grain can be bonded directly into the surface of the working disk or be present in the form of an areal covering of the working disk by means of a multiplicity of individual abrasive bodies, so-called "pellets", which are mounted onto the working disk (P. Beyer et al., Industry Diamanten Rundschau IDR 39 (2005) III, page 202).

In the case of PPG and pellets grinding, the working disks are embodied in ring-shaped fashion, and the rolling apparatus for the running disks is formed from an inner and an outer pin wheel, which are arranged concentrically with respect to the rotation axis of the working disks. Inner and outer pin wheels thus form sun gear and internal gear of a planetary gear arrangement by means of which the running disks revolve with inherent rotation like planets around the central axis of the arrangement—hence the name "running disks".

Finally, a further method similar to PPG grinding is simultaneous double-side orbital grinding, which is described for example in US 2009/0311863A1. In the case of orbital grinding, too, the semiconductor wafers are inserted in receiving openings of an insert carrier, which guides them during processing between the rotating working disks. In contrast to PPG or pellets grinding, however, an orbital grinding apparatus has only a single insert carrier, which covers the entire working disk. The working disks are not embodied in ring-shaped fashion, but rather in circular fashion. The insert carrier is guided by means of a plurality of guide rollers arranged outside the working disk and around the circumference thereof. The rotary spindles of said guide rollers are eccentrically connected to drive spindles. As a result of the rotation of said drive spindles, the guide rollers perform an eccentric movement and thereby drive a gyroscopic or orbital movement of the insert carrier. In the case of orbital grinding, therefore, the insert carrier does not rotate about its own central axis, nor does it revolve about the rotation axis of the working disks, but rather performs an oscillating movement in the form of small circles over the area of the working disks. This orbital movement is characterized by the fact that, under each semiconductor wafer thus guided by the insert carrier, there is always a respective area in the spatially fixed reference system which, during the movement, lies continuously completely within the area swept over by the semiconductor wafer.

DE102007049811A1 stipulates that, for carrying out the PPG or pellets grinding method, use is made of running disks whose thickness is equal to or thinner than the final thickness of the semiconductor wafers processed thereby. This also applies to orbital grinding, for the same reasons. The running disks (PPG, pellets grinding) and the insert carrier (orbital grinding) are therefore very thin, for example less than typically 0.8 mm when processing a silicon wafer having a diameter of 300 mm. Furthermore, DE102007049811A1 stipulates that the running disks and the insert carrier have to be sufficiently stiff in order to withstand the forces acting during processing, and that their surfaces which come into contact with the working layer during processing have to be particularly resistant to wear and are permitted to have only little interaction with the working layer, in order that the working layer does not become blunt and need to be reconditioned (redressed) through undesirably frequent and complex trimming. In accordance with DE102007049811A1, therefore, running disks suitable for carrying out the PPG method, for example, preferably comprise a core composed of a first material, which has a high stiffness, said core being completely or partly coated with a second material, and also at least one opening for receiving a semiconductor wafer. Preferably, in accordance with DE102007049811A1, a thermosetting polyurethane having a hardness of between Shore 40 A and Shore 80 A is used as second material. This has proved to be particularly resistant to wear in relation to diamond, the abrasive substance preferably used.

In this case, the antiwear layer is applied by spraying, dipping, flooding, spreading, rolling or blade coating. However, preference is typically given to coating by molding in an injection mold, into which the first material is inserted in a centered manner with space for the coating on the front and rear sides. Alternatively, coating with a layer with excess thickness and subsequent grinding back to the desired target thickness are also known.

DE102007049811A1 explains that very high frictional forces act on the antiwear layers known in the prior art. Said forces are much greater than the frictional forces owing to the chipping capacity exerted by the material removal on the semiconductor wafer.

On account of the high forces, the stiffness-imparting core of the running disk has to be very thick in order that the running disk is still sufficiently stable. As a result, only a small proportion of thickness—a maximum of 100 μm but in practice significantly less—remains for the coating of the running disk, which considerably restricts the service life thereof and means high costs for the wearing part running disk.

Moreover, the high frictional forces have the effect that the semiconductor wafers, during processing, are not moved in a manner which is as far as possible with low forces and "free floating", as desired. As a result, the advantages of simultaneous double-side processing which lead to a particularly high flatness of the semiconductor wafer are partly nullified if the processing is carried out using running disks known in the prior art.

According to DE102007049811A1, the high frictional forces owing to the small layer thickness bring about particularly harmful peeling forces between core material and coating of the insert carrier. Said forces lead to premature detachment of the coating through delamination to an increased extent. In order to counteract layer detachment, which leads to the fracture of the semiconductor wafer and usually also of the running disk, WO2008/064158A2, for example, describes the use of an additional layer of an adhesion promoter between core material and antiwear coating of the running disk. However, this, too, does not solve the problem of the excessively low layer adhesion, such that antiwear-coated running disks known in the prior art are unsuitable for carrying out the PPG method and related grinding methods.

Finally, DE102007049811A1 and WO2008/064158A1 also describe running disks, the core material of which is only partly coated with an antiwear layer. However, these prove to be particularly susceptible to premature layer detachment and are therefore likewise unsuitable for the processing of semiconductor wafers.

SUMMARY

In an embodiment, the present invention provides insert carriers used in PPG and related grinding methods that can have a lengthened use period, and simultaneously ensures a free-floating processing of the semiconductor wafers without risk of fracture for insert carrier and semiconductor wafer.

In an embodiment, the present invention provides

BRIEF DESCRIPTION OF THE FIGURES

Exemplary embodiments of the present invention are described in more detail below with reference to the drawings, in which:

FIG. 5 shows a core (first material) of a running disk in plan view;

FIG. 6A-C shows comparative examples of running disks with conventional coatings in cross section;

DETAILED DESCRIPTION

Figure 1:
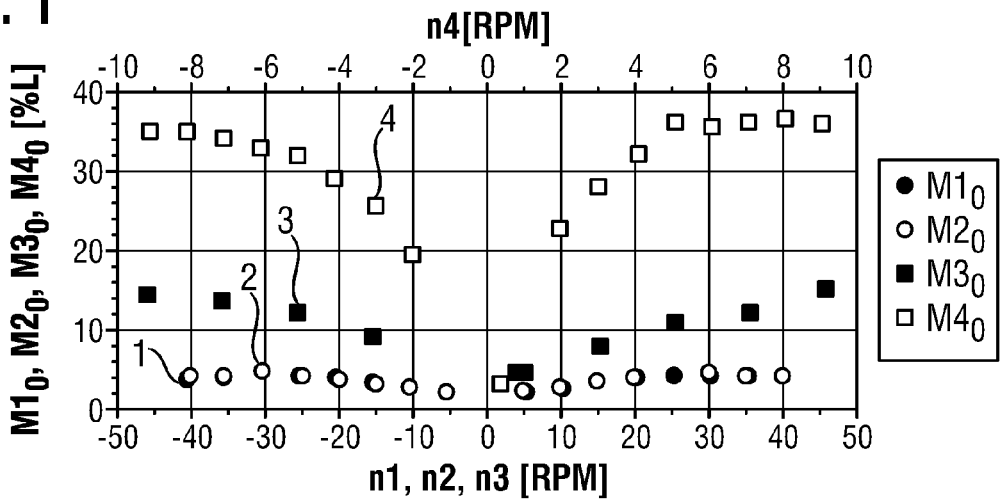
FIG. 1 shows idling torques of the main drives for different rotational speeds.

In an embodiment, the present invention provides an insert carrier, suitable for receiving one or a plurality of semiconductor wafers for the double-side processing thereof between two working disks of a lapping, grinding or polishing apparatus, comprising a core composed of a first material having a first and a second surface, wherein the first and the second surface each bear a coating composed of a second material, said coating completely or partly covering the first and second surfaces, and also at least one opening for receiving a semiconductor wafer, wherein that surface of the coating which is remote from the core has a structuring consisting of elevations and depressions, characterized in that the correlation length of the elevations and depressions of the structuring is in the range of 0.5 mm to 25 mm and the aspect ratio of the structuring is in the range of 0.0004 to 0.4.

The invention can be employed both in the case of processing methods with revolving insert carriers (PPG or pellets grinding method or double-side lapping) and in the case of processing methods with non-revolving insert carriers (orbital grinding, orbital pellets grinding or orbital lapping). For the sake of simplicity, therefore, hereinafter the term "insert carrier" is used synonymously for "running disk" (revolving; PPG, pellets grinding) and for "insert carrier" (non-revolving; orbital method). These methods are described further above in the section "Prior art".

Embodiments of the invention are based, in part, on the observation that running disks available in the prior art have high friction or tend toward the premature detachment of parts of a coating. Both are extremely undesirable and make it more difficult to carry out the PPG grinding, for example, or make it impossible. In particular, it has been observed that the total frictional forces of running disk and semiconductor wafers are significantly greater than those of the semiconductor wafers on account of the material removal alone (chipping capacity, chipping friction).

It has furthermore been observed that this high friction of running disks known in the prior art overloads the running disk (bending and fracture of the running disk) and that running disk and semiconductor wafer move non-uniformly and non-reproducibly ("stick & slip", chatter, vibration). Finally, it has been recognized that the forces acting on the semiconductor wafer do not compensate for one another, that is to say that the desired, largely force-free (force-compensating) "free floating" processing of the semiconductor wafer cannot be carried out with running disks known in the prior art and the semiconductor wafers processed in this way are subjected to constraining forces such as are known from non-force-compensating methods in which the workpieces are clamped.

Furthermore, it has been observed that the high friction of the running disks available in the prior art leads, in particular, to an unsuitability of a fitted antiwear coating since the latter is wholly or partly detached during processing under high force action (in particular peeling forces). In particular, it has been observed that usually the entire thickness of the coating, that is to say the entire layer stack comprising useful layer and adhesive intermediate and primer layers present, if appropriate, is detached from the support—the core of the running disk.

Detached fragments of the surface layers or of the antiwear coating of a running disk pass into the working gap between semiconductor wafer surface and working layer. On account of the high hardness of the working layers (grinding pads, pellets), the punctiform load exerted by a layer fragment on the semiconductor wafer cannot be compensated for by elastic deformation of the working layer, and the semiconductor wafer therefore immediately breaks.

Specifically, some embodiments of the invention are based on the observation, in particular, that the probability of premature layer detachment increases with the friction to which the layer is subjected when sliding on the working layer, and with the total length of the edge of the coating of the running disk.

The inventors have recognized that a coating of the core consisting of a first material with a second material, the surface of which has the elevations and depressions according to embodiments of the invention, is not only very resistant to wear but also has low sliding friction. The structure of the insert carrier according to the invention is explained in detail below:

The insert carrier comprises a core composed of a first material, which imparts the necessary stiffness to the insert carrier. The first material therefore preferably has a high stiffness. Preferably, the first material is a metal, in particular a steel, since the latter has a high modulus of elasticity (stiffness). A hardened steel is particularly preferred because it has a high hardness and tensile strength, such that the running disk is not plastically deformed even upon relatively great flexure and permanently maintains its desired flatness. In this case, a Rockwell hardness of HRC 30 to 60 is particularly preferred. The core consisting of the first material has two surfaces, of which the first, during the use of the insert carrier, faces one working layer and the second faces the other working layer of the double-side processing apparatus.

The second material preferably has a high abrasion resistance. Plastics such as polyurethane are preferred; a thermosetting polyurethane having a hardness of 60 to 95 according to Shore A is particularly preferred.

The second material is connected to the first material in such a way that it has a highest possible adhesive strength, that is to say that forces as high as possible are required to separate the second material from the first material. In this case, the adhesion at the interface between first and second materials is preferably greater than the cohesion within the second material. Adhesion denotes the force that has to be expended in order to overcome the material attachment force with which a first material is connected to a second material along an interface. Cohesion denotes the force that has to be expended in order to overcome the material holding-together force that prevails between the molecules or within the molecules of a material and thus brings about a homogeneous material bond of the material. It is therefore preferred for a loss of material of the coating, such as occurs as a result of wear as a result of friction unavoidably in the course of use, to take place via removal of—microscopically small—quantities of the coating material itself (cohesion failure) and not via detachment of continuous regions of the coating material from the underlying first material (core) of the insert carrier along the interface (adhesion failure).

Strong adhesion can be effected by inherent adhesive action of the first material with the second material (van der Waals' forces), by positively locking connection (toothing, undercuts) or by applying an additional, adhesion-promoting third layer between first and second materials.

That surface of the second material which is remote from the core has a structuring consisting of elevations and depressions. An elevation is a region of greater height which has a surface which faces away from the core of the insert carrier and which can come into contact with one of the working disks of the apparatus for lapping, grinding or polishing the semiconductor wafers. A depression is a region of lesser height whose surface facing away from the core of the insert carrier cannot come into engagement with a working disk. According to the invention, elevations and depressions are in this case always connected to one another in the form of a continuous layer.

The area proportion constituted by the elevations in the total area of the coating is preferably between 5% and 80%. The percentage indicated relates to the area proportion that comes into contact with the working disks. This area proportion is also referred to as percentage contact area for short.

It has been found that the aspect ratio and typical structure size of the structured coating have to be chosen from limited ranges in order that the structuring is effective according to the invention, that is to say that a reduction of friction is obtained and no coating material is detached from the insert carrier.

It has thus been found that the characteristic lateral extent of the structures (elevations and depressions) with which the coating is provided has to be chosen from a limited range in order to obtain a reduction of the sliding friction according to the invention. In this case, it has emerged that it is virtually unimportant whether the structuring of the coating is described by the distribution and extent of the elevations or the distribution and extent of the depressions. A characteristic length can be specified as a correlation length $\lambda$, for example. The specification of the correlation length has the advantage that it constitutes an intrinsic property of the entire coating and is independent of details of the locally chosen embodiment of the pattern of elevations and depressions. The correlation length results from the two-dimensional autocorrelation function $$\varphi(\bar{\lambda}) = 1/A \int_A \chi(\bar{r}) \cdot \chi(\bar{\lambda} - \bar{r}) d\bar{r},$$

where $\chi(\bar{r})=1$, if an elevation is situated at the location $\bar{r}$, $\chi(\bar{r})=-1$, if a depression is situated at the location $\bar{r}$, as that length $\lambda=|\bar{\lambda}|$ for which $\phi(\bar{\lambda})=½$ holds true.

A denotes the total area of the coating over which the two-dimensional integral extends, and $d\bar{r}=d\chi \cdot dy$ denotes the infinitesimal area element.

The autocorrelation thus indicates the probability with which on average an element of the coating—that is to say elevation or depression—is correlated with an element at the distance $\lambda=|\bar{\lambda}|$. This probability assumes the value 1 (strict correlation) if identical elements are situated at the location $\bar{r}$ and simultaneously at the location $\bar{\lambda}-\bar{r}$, that is to say in each case elevations $(1\cdot1=1)$ or depressions $((-1)\cdot(-1)=1)$; the value $-1$ (anticorrelation) if precisely different elements are situated at $\bar{r}$ and $\bar{\lambda}-\bar{r}$, that is to say either an elevation is situated at $\bar{r}$ and at the same time a depression is situated at $\bar{\lambda}-\bar{r}$ $((+1)\cdot(-1)=-1)$ or a depression is situated at $\bar{r}$ and at the same time an elevation is situated at $\bar{\lambda}-\bar{r}$ $((-1)\cdot(+1)=-1)$; and finally the value 0 if the elements at $\bar{r}$ and $\bar{r}=(x,y)$ are uncorrelated on average (sometimes elevation, sometimes depression; sum of uniformly distributed instances of "+1" and "−1" yields zero). By definition, the identity $\chi(0)=1$ always holds true. Integration over all $\bar{r}$ and division by the area over which integration is effected yields averaging, such that $\phi=\phi(\bar{\lambda})$ actually indicates the probability, averaged over the entire coated area, of encountering elements of identical type at the distance $\lambda=|\bar{\lambda}|$.

The correlation length is preferably between 0.5 and 25 mm, particularly preferably between 1 and 10 mm.

Besides the lateral extent of the structures, the aspect ratio thereof is also of considerable importance. Aspect ratio denotes the ratio of the height difference between an elevation and a depression to the lateral extent of the elevation or depression. In order to calculate the aspect ratio according to the invention, the lateral extent is equated with the above-defined correlation length of the structuring. It has been observed that no reduction of the friction between coating of the insert carrier and working layer of the processing apparatus occurs in the case of an excessively large aspect ratio, just as in the case of an excessively small aspect ratio.

A large aspect ratio is present if the coating has great height modulations within short lateral distances, for example in the form of numerous small elevations each having a large height but a small lateral extent which are separated from one another by a continuous network of depressions surrounding them. It has been found that such elevation "pins" are greatly deformed by the lateral frictional forces acting during working use. This leads to material stresses particularly at the base of the elevation, at which the latter is connected to the surrounding regions of the depressions. The coating material tears there, and parts of the elevations can be detached from the assemblage of the entire coating. This would lead, as described, to fracture or damage of the semiconductor wafer.

A large aspect ratio is likewise present if, conversely, the structuring of the coating is present for example in the form of a multiplicity of individual depressions ("blind holes") surrounded by a network of continuous elevations. It has been found that these blind-hole-like depressions fill up and become clogged with the abrasive slurry that arises during the material-removing processing of the semiconductor wafers. The effect of the structuring is thereby nullified.

In contrast thereto, a small aspect ratio is present if the coating has small height modulations within wide lateral distances, for example in the form of wide depressions or extensive elevations having only a small height difference between elevation and depression. In the case of an excessively small aspect ratio, too, the coating does not act according to the invention, as is explained below.

The reduction of the sliding friction between the coating of the insert carrier and the working layer of the processing apparatus is evidently brought about by the fact that a suitably structured coating increases the thickness of the film of supplied cooling lubricant—preferably water in the case of PPG—that is situated between coating and working layer. The insert carrier floats by means of a type of "aquaplaning" effect upon relative movement between insert carrier and working layer, as a result of which the sliding friction is reduced. This is explained by the fact that evidently the depressions take up a supply of cooling lubricant and release it again during the sliding of the insert carrier over the working layer as a result of the shear gradient in the cooling lubricant film on account of the relative movement. The released cooling lubricant can leave the depressions only by flow transport over the elevations. If the depressions are too small or too shallow and the elevations are too wide, the entrained quantity of cooling lubricant does not suffice to increase the film thickness above the elevations in such a way that an effect of reducing sliding friction is obtained. Conversely, if the depressions are too large and the elevations too small, not enough cooling lubricant can be fed to fill the reservoir of the depressions such that enough cooling lubricant is obtained for increased film formation of the surrounding elevations. In this case, too, a thicker film does not form and a friction-reducing "floating" of the insert carrier likewise fails to occur.

An aspect ratio of the structuring of between 0.0004 and 0.4 has proved to be suitable. A range of between 0.004 and 0.1 is preferred.

The second material partly or completely covers the first and the second surface of the first material. Preferably, each of the two surfaces of the first material has exactly one continuous layer of the second material. The coating according to the invention therefore preferably does not consist of a plurality of non-continuous regions ("islands"), but rather of exactly one continuous region per surface. In this case, an area is designated as "completely continuous" exactly when there is exactly one edge line of said area which encloses the entire area.

It has been found that a coating composed of a second material has the highest adhesive strength on the first material, that is to say does not tend toward detachment, exactly when, for a given content of the area occupied by the coating in each case on the first and the second surface of the second material, the ratio of "edge" to "area" is as small as possible. This means, more precisely, that the form of the areas respectively occupied by the coatings of the first and second surfaces of the first material, for a given area content, should preferably be chosen in each case such that the length of each of the two, in each case exactly one edge line which completely encloses said area in each case becomes minimal. Ideally, therefore, each of the two coatings is in each case exactly enclosed by a circular line.

This is because it had been found that detachment of a coating possibly having inadequate adhesive strength always proceeds from the edge of the coating, that is to say from the line which in each case exactly encloses the area occupied by the coating. Layer detachment from the center of the closed layer was practically never observed. Therefore, particular preference is given to coatings whose form is chosen such that the sum of all the edge lines which delimit the area occupied by the coating is as small as possible. The edges delimiting the coating are therefore intended to be curved as uniformly as possible, without additional bulges and incisions.

The structuring of the surface of the second material can be achieved in various ways:

(a) The first material can have a uniform thickness in the region covered by the second material. In this case, the second material must have a non-uniform thickness in order to obtain the desired surface structure.

(b) On the other hand, the first material can also have a non-uniform thickness in the region covered by the second material. The second material has a uniform thickness which follows the thickness profile of the first material in a positively locking manner. In this case, the elevations and depressions are predefined by the thickness structure of the first material.

(c) It is also possible for both the first and the second material to have a non-uniform thickness, wherein the thickness profile of both materials is implemented non-complementarily with respect to one another. In this case, the surface structure results from the sum of the thickness fluctuations of the first and second materials.

A thickness modulation of the second material (cases (a) and (c)) can preferably be obtained by means of the following method: the first material is arranged in a centered manner between two half-molds whose sides facing the first material in each case comprise cavities. The walls of the half-molds which delimit the cavities have a structure produced by embossing, grinding, engraving, knurling, grooving, milling, turning or etching, such that a non-uniform width of the cavity and thus of the molding effected with the second material arises in the subsequent step. The cavities are then simultaneously filled with a flowable chemical precursor of the second material (injection molding). The precursor is subsequently converted into the second material for example by crosslinking or curing, the half-molds are removed and the core coated with the second material in this way is removed.

Likewise, a thickness modulation of the second material can preferably also be obtained by means of the following method: the first material is coated largely homogeneously with a non-cured chemical precursor of the second material, said precursor being diluted in a manner ready for injection, in a spraying method, alternatively also by dipping, flooding, spreading, blade coating or screen printing. In this case, both sides can be coated simultaneously (dipping, flooding) or successively (spreading, blade coating, printing). After coating, the solvent is allowed time for flashing off (evaporation), such that the chemical precursor becomes covered with a skin, but does not yet cure fully. Of the thermosetting polyurethanes preferred as second material, the particularly wear-resistant types are generally hot-crosslinking, that is to say that the chemical precursor applied does not cure fully anyway at room temperature. The running disk is then pressed between two plates composed of heat-resistant plastic under pressure and with supply of heat. The plates preferably consist of self-releasing material such as polytetrafluoroethylene (PTFE) or silicone rubber; alternatively, those surfaces of the plates which face the running disk can also be coated beforehand with a release agent (waxes, silicones). Those surfaces of the plates which face the running disk are provided, by means of grinding, engraving, milling, etc., with a structuring that is complementary to the texture provided for the structuring of the second material. By means of pressing with action of heat, the still plastically deformable chemical precursor of the second material is thus converted into the desired form and cures in the latter. After the removal of the shaping plates, the surface of the second material is present with the desired form.

A thickness modulation of the first material (cases (b) and (c)) can be obtained by reshaping (embossing, engraving, knurling, grooving, compression, deep-drawing), chipping removal (grinding, milling, turning), perforation (stamping, drilling, grinding, milling) or chemical treatment (etching).

The application of the second material to the first material then takes place in case (b) for example by means of molding or by spraying. In the case of molding, for this purpose, in the two mold halves, the height profile of the surface—facing the respective mold half—of the second material clamped in between them has to be precisely simulated in each case, thus resulting in a uniform coating thickness in each case on both sides. Applying the coating by means of spraying application involves applying the double-sided coatings composed of a multiplicity of individual layers sprayed on very thinly with flash-off times in between in order to prevent a further film flow. In this case, each individually applied film is so thin that the surface tension cannot contract the film at contour edges, elevations and depressions, thus giving rise overall to a film stack which has a very uniform thickness and which precisely follows the form profile of the underlying first material.

The linings of the openings for receiving the semiconductor wafers which are known from the prior art can be combined with the coating consisting of the second material, as follows: the lining can consist of a third material, which extends continuously from the first surface of the first material through the opening in the first material as far as the second surface of the first material. Preferably, the third material completely covers all wall areas of all openings for receiving semiconductor wafers and all other openings in the first material.

It is likewise preferred for the third material to be identical to the second material and to form a continuous layer therewith, which layer largely completely covers the first and second surfaces of the first material and the walls of all openings. Particularly preferably, a complete coating with a second material identical to the third material is produced in one work operation, for example by means of molding between mold parts that allow a flowable chemical precursor of the second material to flow around the entire regions of the first material which are provided for coating, or by "all-round" spray coating of all regions provided for coating in one spraying operation.

In the case of a running disk (for example for a PPG method), however, the outer toothing and also a narrow edge region adjoining the outer toothing remain free of the second and third materials. Further regions within the coated area can likewise preferably remain free, but always such that no point on the first material (core of the insert carrier) touches the working layer of the processing apparatus. During processing, the insert carrier is elastically deformed on account of the forces (drive, friction) acting on it, for example also in a vertical direction (torsion, curvature). The areas that remain free therefore have to be chosen according to size and position such that the insert carrier does not come into contact with the working layer even in the case of this elastic deformation.

The deformation is particularly severe in the region of the outer toothing, via which forces are introduced in the example of a revolving running disk. A partial coating without coming into contact with uncoated regions of the running disk can be achieved for example as follows:

Often, in processing methods with a revolving running disk (PPG, pellets grinding, lapping, DSP), the running disks are specially guided in the region of the outer toothing in order to avoid bending of the running disk in this region, in which they cannot be guided by the working disks on both sides. This is done for example by using specific pin wheel sleeves on the pins of the rolling apparatus which have grooves into which the running disks engage, such that bending is prevented. In order to avoid abrasion of the coating in the region with which the tooth flanks dip into said grooves, it is preferred additionally to leave uncoated a narrow edge region of the running disk of at least the groove depth. Preferably, the running disk remains uncoated over a width of 0 to 2 mm, measured from the radius of the root circle of the outer toothing.

In the case of processing methods with a non-revolving insert carrier (orbital grinding, orbital polishing), the insert carrier is held along its outer circumference generally in a stable guide ring, which is guided outside the external diameter of the working disks and thereby structurally prevents contact of the insert carrier with the working layers in the outer region. As a result of bulging or curving on account of drive forces having an effect during processing, the insert carrier can touch the working layer only in the inner region. Therefore, in the example of a non-revolving insert carrier, it is preferred to leave the central region completely coated.

The insert carriers according to the invention can be used in various double-side processing methods. Therefore, the invention also relates to a method for the simultaneous double-side material-removing processing of at least one semiconductor wafer between two rotating working disks, wherein the semiconductor wafer lies in a freely movable manner in an opening of an insert carrier and is moved by the latter under pressure in the working gap formed between the working disks, wherein an insert carrier according to the invention is used, and wherein the elevations of the second material come into contact with one of the working disks, and wherein the first material and also the depressions of the second material do not come into contact with one of the working disks.

The invention is preferably used in methods in which each working disk comprises a working layer containing bonded abrasive. In this case, a cooling lubricant containing no abrasive is fed to the working gap. Methods of this type are referred to as grinding methods. The working layers can be present in the form of pads, films or abrasive bodies which are continuous or composed of individual segments and which can be removed from the working disk preferably by means of a peeling movement.

The invention can be used both in double-side processing methods with planetary kinematics and in orbital methods.

In the case of an orbital method, the working disks are circular and exactly one insert carrier is used, which covers the entire working disk and is driven by eccentrically rotating guide rollers, arranged at the circumference of the working disk, to effect an orbital movement in such a way that under each semiconductor wafer there is always a respective stationary area which at any time is completely covered by the semiconductor wafer.

In the case of methods with planetary kinematics, the working disks are ring-shaped. At least three insert carriers (which in this case are also referred to as running disks) each having at least one cutout are used. The insert carriers each have an outer toothing, such that they revolve with inherent rotation about the rotation axis of the double-side processing apparatus by means of a rolling apparatus comprising an inner and an outer pin wheel arranged concentrically with respect to the rotation axis of the working disks, and the toothing.

EXAMPLES AND COMPARATIVE EXAMPLES

Experiments with coatings that were different according to form, construction and structure were carried out in order to understand the causes of the problems observed for the running disks known in the prior art and to elaborate a solution.

A precise measurement of the frictional forces that occur during the movement of the running disks relative to the working layers was shown to be important. Since the friction relevant to the running disk stress is a wet sliding friction during processing, it was found that this also has to be determined during processing and with real rotational speeds (kinematics) of the apparatus drives and real bearing forces (grinding force, grinding pressure). This also became evident from the observation that, under real grinding conditions, the frictional forces that occur are determined by a mixture of sliding friction of the working layer (diamond, fillers) and rolling friction at the granular abrasion of semiconductor material released during the processing of the semiconductor wafers. This cannot be represented in the laboratory set-up without processing that simultaneously removes semiconductor wafer material.

The investigations were carried out on an apparatus suitable for carrying out the PPG grinding method, such as is described for example in DE19937784A1. A double-side processing apparatus of the AC-2000 type from Peter Wolters GmbH was used. This apparatus has two ring-shaped working disks having an external diameter of 1935 mm and an internal diameter of 563 mm and an inner and an outer pin wheel. The rated power outputs L of the drives are indicated in table 1.

The rolling apparatus formed from inner and outer pin wheels can accommodate up to five running disks. Exactly five running disks in each case were actually used for the investigations. The running disks have an outer toothing that engages into inner and outer pin wheels. The pitch circle diameter of said outer toothing is 720 mm. The running disk therefore has a useful area in which it is possible to arrange up to three openings for receiving a respective semiconductor wafer having a diameter of 300 mm or up to six openings for receiving a respective semiconductor wafer having a diameter of 200 mm or only exactly one opening for receiving a semiconductor wafer having a diameter of 450 mm. For the investigations, running disks each having three openings for three semiconductor wafers having a diameter of 300 mm were used throughout.

FIG. 5 shows the running disk used for the experiments. Said running disk comprises openings 21 for receiving the semiconductor wafers, an outer toothing 22, dovetail-shaped cutouts 23 for forming a positively locking bond with linings 24 (plastic inserts), which prevent the direct contact of the semiconductor wafer with the first material (steel) forming the core of the running disk, and compensation openings 25 for passage or exchange of the cooling lubricant which, during processing, is added to the working gap formed between the two working disks. For the investigations, exclusively pure water without further additives was used, which was fed to the working gap during processing of the semiconductor wafers with a flow rate of a constant 28 l/min. (26 denotes a sectional line through the running disk used along which, further below, FIG. 7 shows examples and FIG. 6 shows comparative examples of running disks in cross section).

For the friction measurements under PPG grinding conditions, the working disks were covered with a grinding pad "Trizact Diamond Tile", type 677XAEL from 3M. Said grinding pad contains diamond as fixedly bonded abrasive. For each series of experiments, the grinding pad was in each case freshly trimmed (leveled) and dressed by means of a method as described for example in T. Fletcher et al., Optifab 2005, Rochester N.Y., May 2, 2005, in order to ensure identical starting conditions (cutting sharpness, cutting capacity) for all experiments.

The rotational speeds (in revolutions per minute, RPM)—used for the measurements—of the drives of the PPG processing apparatus are indicated in table 1. In this case, "abs." denotes the absolute rotational speeds of the drives (laboratory system) and "rel." denotes the rotational speeds in the reference system concomitantly moved with the running disks, the so-called inherent system, which provides a particularly universal, tool-invariant description of the processing kinematics. n1, n2, n3, n4 denote the chosen absolute rotational speeds for upper and lower working disks and inner and outer pin wheels in the spatially fixed (installation-related) reference system. Ω denotes the average rotational speed-resulting in the inherent system—of the working disks relative to the midpoints of the revolving running disks, ΔΩ denotes the deviation of the individual rotational speeds of the working disks from the average rotational speed, $\omega_0$ denotes the inherent rotation of the running disks about their respective midpoints in the spatially fixed reference system, and $\sigma_0$ denotes the rotational speed of the revolution of the midpoints of the running disks about the center of the apparatus in the spatially fixed reference system. Between the parameter sets which are expressed by the vectors (n1, n2, n3, n4) and (Ω, ΔΩ, $\omega_0$, $\sigma_0$) in their respective reference systems and which in each case completely describe the movement sequences during processing, it is possible to effect conversion by means of multiplication by a transformation matrix representing the known planetary gear equations.

TABLE 1

| | abs. | | | rel. | | L | |
|---|---|---|---|---|---|---|---|
| n1 | −32 | RPM | Ω | 28.5 | RPM | 18 | kW |
| n2 | +25 | RPM | ΔΩ | −0.12 | RPM | 18 | kW |
| n3 | +4 | RPM | $\omega_0$ | −11.52 | RPM | 4.5 | kW |
| n4 | −6 | RPM | $\sigma_0$ | −3.38 | RPM | 6 | kW |

The friction is determined on the basis of the motor power that is actually output (in percent relative to the respective rated power output L of the relevant drive, see table 1; abbreviated to "% L"). For this purpose, it is necessary firstly to determine the idling powers on account of bearing friction and other losses that have to be eliminated from the power outputs determined subsequently during processing. FIG. 1 shows the idling powers M1$_0$, M2$_0$, M3$_0$ and M4$_0$ of upper (1) and lower (2) working disk and inner (3) and outer (4) pin wheel with raised upper working disk and without inserted running disks and semiconductor wafers as a function of the corresponding drive rotational speeds n1, n2, n3 and n4.

Figure 2A:
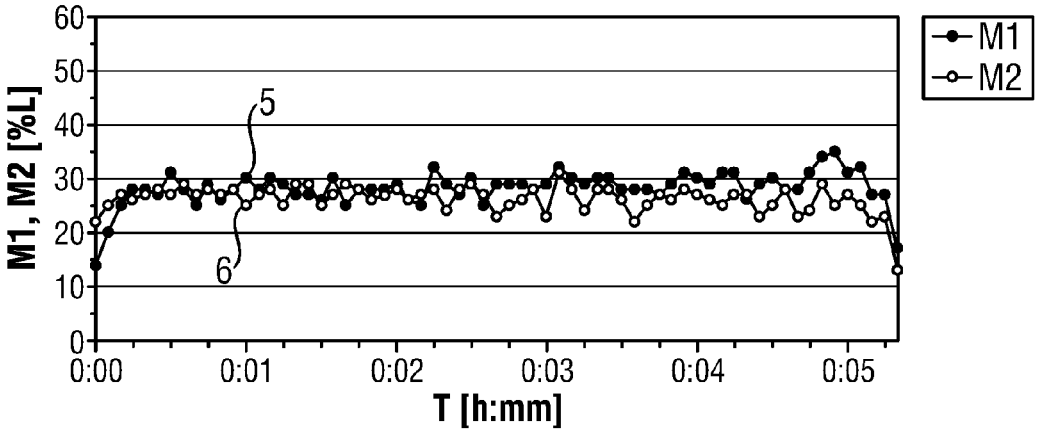
FIG. 2A-C shows torques, bearing force and residual removal of a PPG processing pass.
Figure 2B:
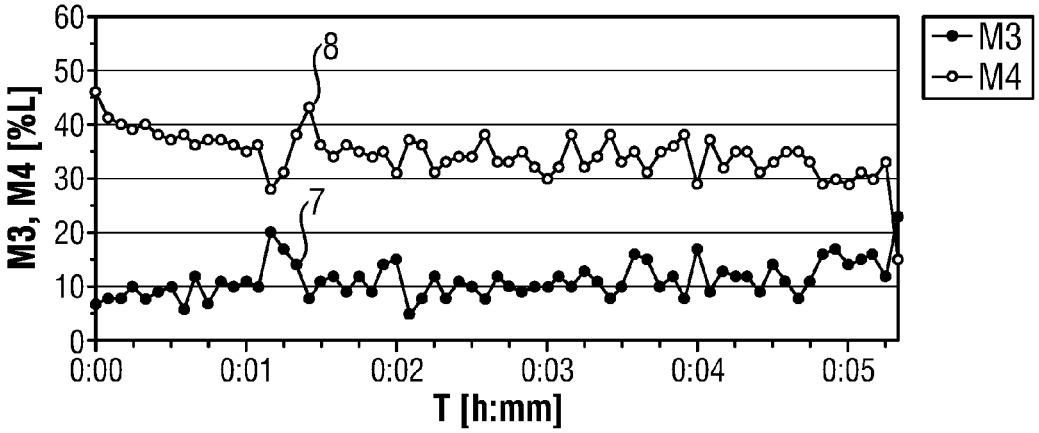
Figure 2C:
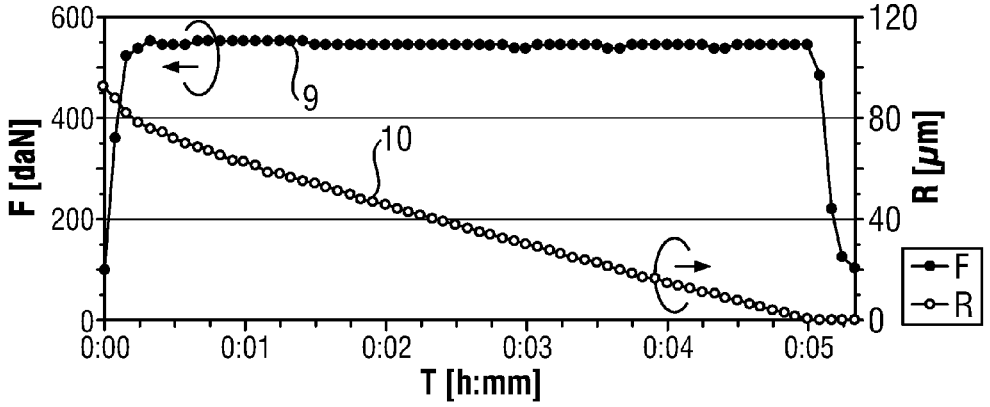

FIG. 2 shows the operating characteristic figures determined during the course of a PPG processing pass against time T (in hours and minutes, h:mm). FIG. 2 (A) in this case shows the torques or power outputs M1 and M2 of upper (5) and lower (6) working disk in percent (% L) of the respective rated power L of the respective drives. FIG. 2 (B) shows the torques M3 and M4 of inner (7) and outer (8) pin wheel, and FIG. 2 (C) shows the profile of the bearing force F of the upper working disk 9 (grinding force, grinding pressure) in decanewtons (daN) and the remaining residual removal R (10) in micrometers (μm) relative to the chosen target thickness of the semiconductor wafers. 550 daN bearing force during the main load phase, in the case of 3×5=15 semiconductor wafers having a diameter of 300 mm, correspond to a pressure of 5.2 kPa (kilopascals), that is to say 0.052 bar. The processing conditions and material removals were chosen such that the total duration of a processing pass from load build-up and start of rotation of the drives at the start of the pass to load reduction and stopping of the rotation of the drives at the end of the pass is between five and seven minutes, as shown by way of example in FIG. 2. In the present example, 90 μm of material were removed for this purpose. The gradient of the residual removal 10 results in an average material removal rate during the main removal step of approximately 17 μm/min (micrometers per minute).

In order to determine the actual friction losses, the idling torques determined in accordance with FIG. 1 are eliminated from the measured drive torques M1, M2, etc. shown by way of example in FIG. 2 (A) and FIG. 2 (B). This results in the actual torques M1*, M2*, etc. The latter are related to the bearing force F that has an effect during processing. Since the material removal rate (rate of material removal) given the same grinding pad, the same trimming conditions and the same rotational speeds (the same path speeds of the workpieces over the working layers) is proportional to the bearing force F, the bearing-force-related net torques M1*/F, M2*/F, etc. are a direct measure of the friction experienced by the totality of running disks and semiconductor wafers during processing. Since the working disks make the main contribution to the removal capacity, only the force-related net torques M1*/F and M2*/F of the upper and lower working disks were considered to a sufficient approximation of the actual friction losses.

Comparative Example 1

In comparative example 1, a running disk coated over the whole area and thickness-homogeneously was used, as is illustrated in FIG. 6 (A): FIG. 6 (A) shows the running disk with opening 21 for receiving a semiconductor wafer, outer toothing 22, "insert" 24 for lining the receiving opening for the protection of the semiconductor wafer, compensation openings 25 for the passage of cooling lubricant, and whole-area coating 27 of the remaining steel core 20.

Figure 3:
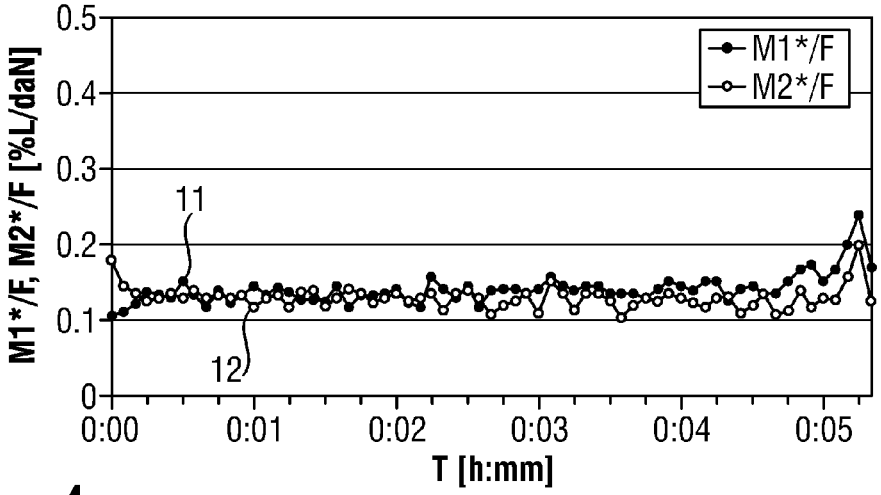
FIG. 3 shows a comparative example of the force-related net torques of the working disks of a PPG processing pass with a method not according to the invention.

FIG. 3 shows the temporal development of the force-related net torques M1*/F and M2*/F of upper and lower working disks for running disks that are not according to the invention. Time is indicated in hours and minutes in the format "h:mm". The net torques are indicated in percent of the rated power output, % L. The running disks comprised a 600 μm thick core composed of hardened high-grade steel which bore on both sides a coating of respectively 100 μm thickness of thermosetting polyurethane having a Shore hardness of Sh 80 A. Steel core and coating were embodied extremely thickness-homogeneously and the coating covered the entire running disk contour. Only the region of the outer toothing was uncoated from the tooth tips to the root circle. The running disk thus corresponded to the illustration in FIG. 6 (A).

In this comparative example 1, the PU coating had been applied by means of a molding method. For this purpose, the steel core processed by means of lapping to particular freedom from undulation and thickness homogeneity was centered between two half-molds of a mold. The two half-molds contained, on the inner sides facing the running disk core, cavities having a form corresponding to the planned coating, and also sprue and venting channels. The mold was filled with a liquid chemical precursor of the coating material (uncrosslinked polyurethane) and cured in the mold (RIM, reaction injection molding). After curing, the half-molds were removed and the running disk coated with thermosetting PU was thus obtained.

On account of the high shape processing accuracy by means of a milling and polishing method, the fluctuation of the total thickness of the running disk from 800 μm was less than ±1.5 μm. On account of the elasticity of the coating (hardness Shore 80 A), it was assumed that the entire coating comes into contact with the working layer (grinding pad), during processing. The coating therefore has a percentage contact area of almost 100%.

The force-related net torques are on average approximately 0.135% L/daN in the comparative example of a smooth running disk (FIG. 6 (A)) in accordance with the prior art as shown in FIG. 3. Very smooth running disks are presented as preferred in the prior art. The reasons are explained in DE10023002B4, for example. In the prior art, preference is even given, where technically possible, not only to a best possible macroscopic flatness, but also to a particularly small microscopic roughness. Reasons for this are explained in DE 10250823B4.

Example 1

In example 1, use was made of a running disk coated over the whole area, as is illustrated in FIG. 7 (A). It has projecting reasons 31 (elevations), which come into contact with the working layer of the grinding apparatus while the PPG method is being carried out, and also recessed regions 30 (depressions), which do not come into contact with the working layer. Elevations and depressions form a continuous area according to embodiments of the invention. A characteristic feature of such a coating that is continuous over the whole area is that the core of the running disk is not visible at any point.

In the case of the whole-area coating shown in FIG. 7 (A), only the region of the outer toothing 22 from the tooth tips to the root circle of the outer toothing was kept free of coating material by masking during coating. This proved to be advantageous since it had been found that, in particular, coating material adhering to the tooth flanks, if appropriate, is detached owing to the high point loading during the rolling of the running disk between inner and outer pin wheels of the processing apparatus. This would immediately lead to fracture of the semiconductor wafer.

The coating had, on both sides of the running disk, in each case a layer thickness of 100 μm in the area of the elevations and of approximately 20 μm in the region of the depressions. The percentage contact area was approximately 40%, and the correlation length describing the average lateral extent of elevations and depressions was approximately 3 mm given a depth of, on average, 30 μm. The aspect ratio was accordingly approximately 0.01.

The running disk had been coated with the same polyurethane (Shore 80 A) as from comparative example 1 by means of an injection molding method (RIM) between two half-molds. The mold cavities provided for the PU molding were identical to those in comparative example 1 according to form and size. In contrast to comparative example 1, however, the walls—facing away from the centered steel core—of the mold cavities to be injected which shape the surfaces of the molding that subsequently come into contact with the working layers of the grinding apparatus were structured with the aid of an engraving method. In this case, the roughness depth was chosen such that the layer molding remained continuous, that is to say that all elevated elevations of the coating that subsequently come into contact with the working layers were connected without interruption by depressions, without giving rise to coating-free areas in which the coated core material of the running disk would be visible. The running disk thus corresponded to the illustration in FIG. 7 (A).

Otherwise, there were no differences in the experimental procedure compared with comparative example 1.

Figure 4:
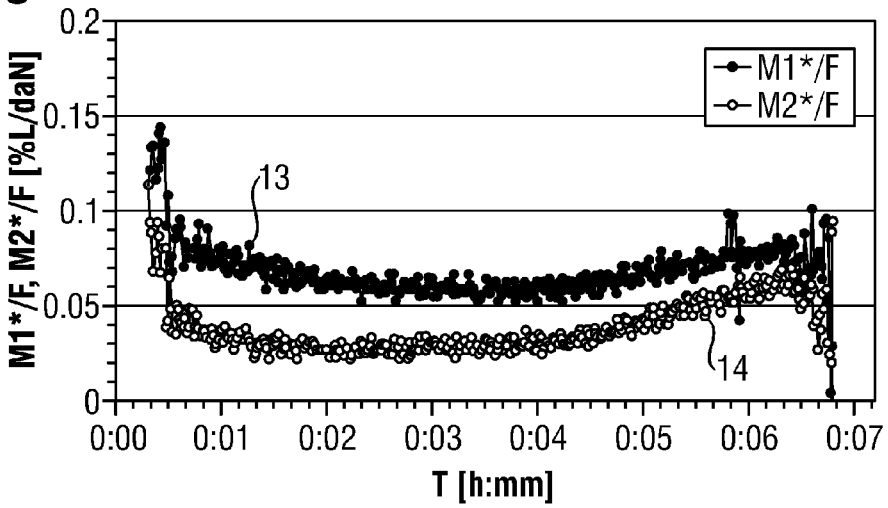
FIG. 4 shows an example of the force-related net torques of the working disks of a PPG processing pass with a method according to an embodiment of the invention.
Figure 7A:
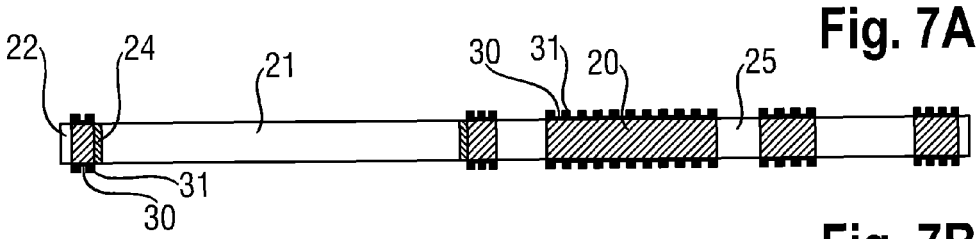
FIG. 7A-C shows examples of running disks with coatings according to a method according to an embodiment of the invention in cross section.
Figure 7B:
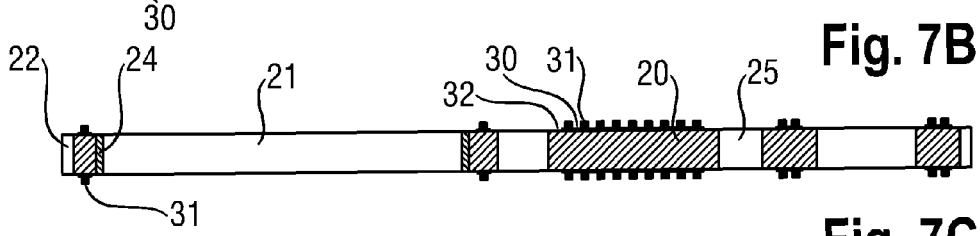
Figure 7C:
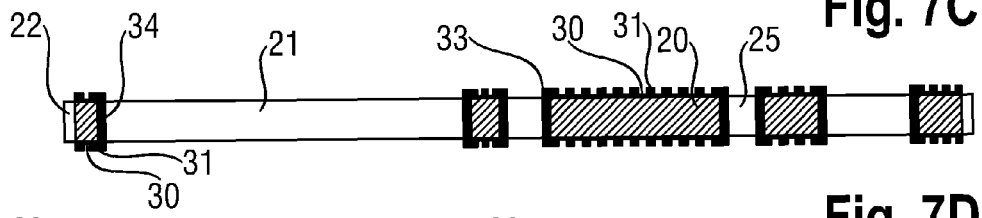
Figure 7D:
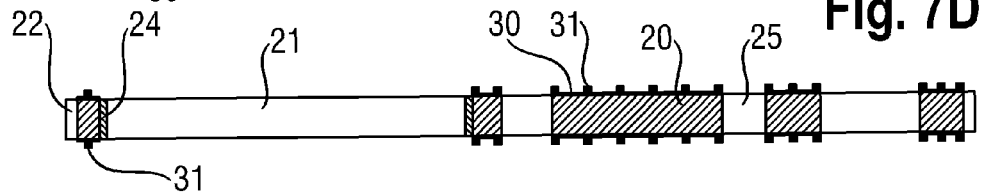
Figure 8A:
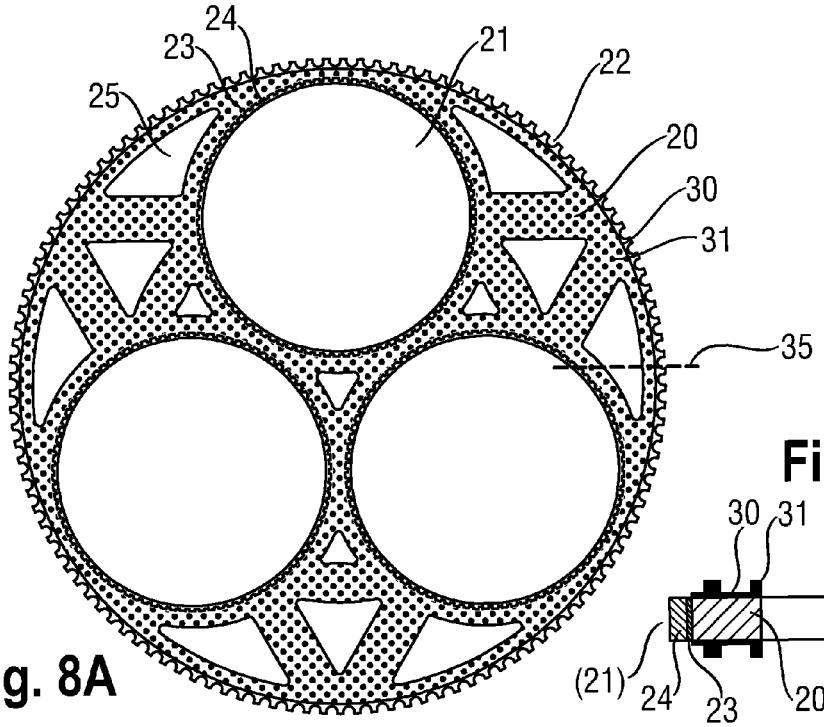
FIG. 8A-C shows examples of running disks with coatings according to a method according to an embodiment of the invention in plan view.
Figure 8B:
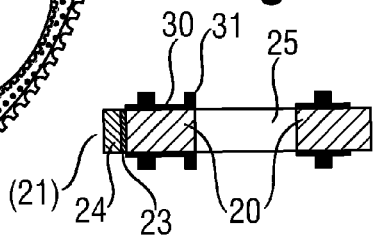
Figure 8C:
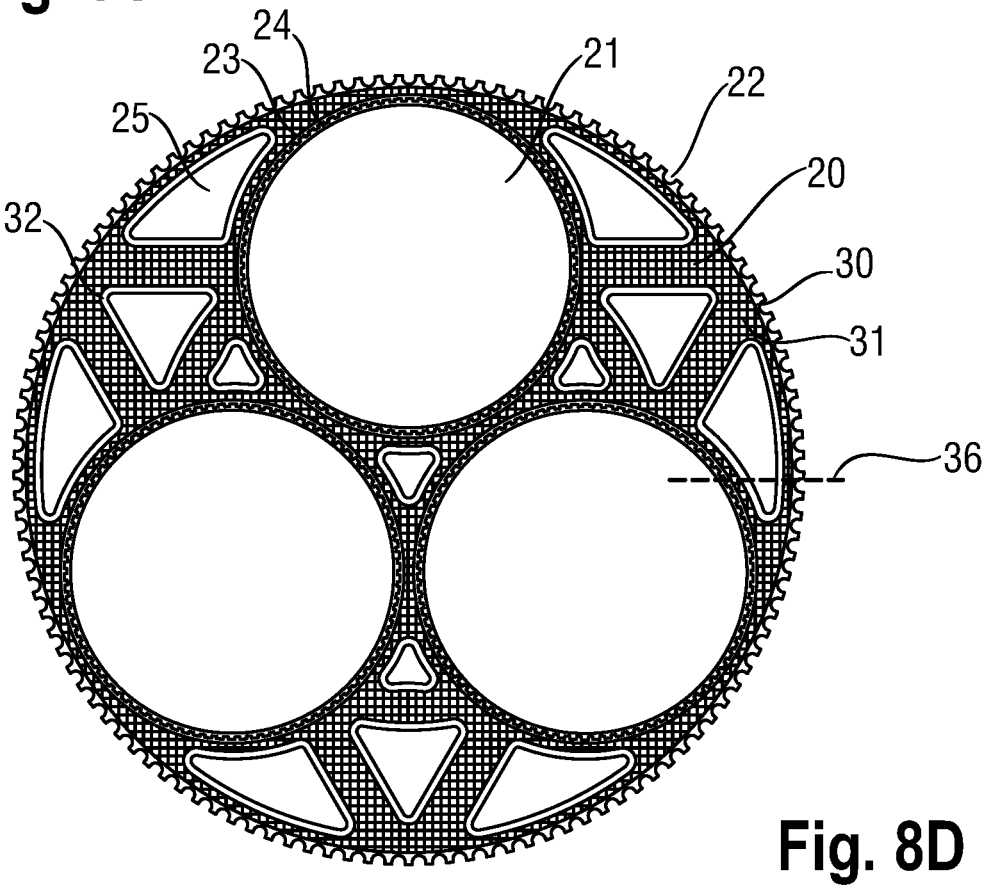
Figure 8D:
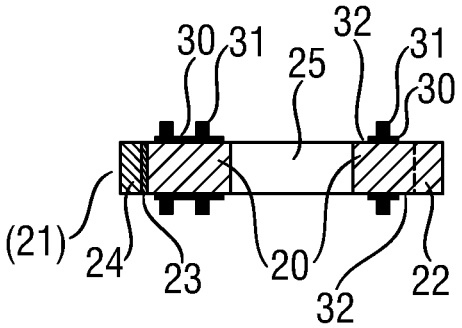

FIG. 4 shows, analogously to FIG. 3 (comparative example 1) the force-related net torques M1*/F and M2*/F that occur when using a running disk in accordance with example 1. The force-related net torques were on average only 0.051% L/daN in the case of example 1. This value was determined by averaging M1*/F and M2*/F over the time range of largely constant friction conditions (between approximately ½ min and 6½ min in FIG. 4). This is less than 40% of the friction produced in comparative example 1—with the same coverage of the running disk with the antiwear layer, the same material of the coating and the same PPG processing conditions (rotational speeds, force, cooling lubrication, grinding pad trimmed before the start of the pass, etc.).

The coating proved to be extremely stable, and, even upon repeated experimental passes, there were no visible partial layer detachments and, in particular, no cases of fracture of the semiconductor wafers.

Examples 2-3 and Comparative Examples 2-4

Table 2 shows further results of examples 2 and 3 according to the invention, and of comparative examples 2, 3 and 4 not according to the invention. The experiments were carried out with differently coated running disks under conditions otherwise identical to those in example 1 and comparative example 1. In all cases, the running disk core corresponded to the illustration in FIG. 5.

For table 2, the average net friction torque <M*> (in percent of the drive rated power output, % L), relative to the average material removal rate <dR/dt> (in micrometers per minute, μm/min) obtained during processing, for both working disks, was determined. This is an even more accurate measure of the friction than the grinding-force-related drive torque M*/F plotted in FIGS. 2 (A) and (B) and FIG. 3, since, with reference to the removal rate actually obtained, the cutting performance per force (with constant path speeds) may fluctuate. Such fluctuations of the force-related cutting performance can occur if it is not possible to produce completely identical "cutting capacities" of the working layers before each experiment by trimming the working layer.

The removal rates are calculated from the determined residual removals by differentiation with respect to time. The residual removals are determined from the distance between the working disks. Since severe noise is overlaid on this method indirectly and in the required micrometer accuracy, the time derivative of this measurement fluctuates all the more. Therefore, the removal rates have to be averaged over the entire duration of the processing pass in order to obtain the required accuracy. For the friction characteristic figure <M*>/<dR/dt>, therefore, no time-resolved pass records as in FIG. 3 and FIG. 4 for the parameter M*/F are available, rather there is available in each case only one—but in return very accurate—characteristic figure per experimental pass. These are compiled for examples 2-3 and comparative examples 2-4 in table 2.

TABLE 2

| Example | <M*>/<dR/dt> | Fracture? |
|---|---|---|
| Example 2 | 1.50 | no |
| Example 3 | 1.60 | no |
| Comparative example 2 | 2.45 | no |
| Comparative example 3 | 2.03 | no |
| Comparative example 4 | 1.45 | yes |

A running disk with coating coverage identical to that in example 1 was used in example 2. This coating was also produced by molding (RIM) with engraved free areas of the mold. However, a higher percentage contact area (approximately 60%) and larger average dimensions of the elevations (approximately 5 mm) and depressions (approximately 4 mm) together with a likewise increased height of the elevations above the depressions (approximately 70 μm) were chosen. The correlation length was approximately 4.7 mm in this example. The aspect ratio of the coating was therefore approximately 0.015. The coating once again corresponds to the illustration in FIG. 7 (A).

For example 3, a coating composed of a thermosetting polyurethane (PU) was produced by manual spraying application (high-pressure spraying, using a spray gun, of a suitably diluted, uncrosslinked PU solution with subsequent evaporation and curing). Manual spraying application leads, if it is carried out in the form of one or just a few relatively thick layers, generally by way of non-uniformities during manual application and edge-contour-dependent surface tensions ("edge bead"), to a layer having a non-uniform thickness. The percentage contact area resulted as approximately 30% (the same overall coating form and area as comparative example 1 and example 1). The percentage contact area was determined after a plurality of processing passes by measurement of the traces of wear becoming apparent on the surface regions coming into contact with the working layer. On account of the spraying application, however, the average lengths of the elevations and depressions were considerably greater than those in the examples from FIG. 3 and FIG. 4 with correlation lengths of approximately 20 to 30 mm. The average height of the elevations relative to the depressions was again between 10 and 20 μm, as was determined by means of a micrometer screw gauge by measurement in the manner of sampling at different points in the region of the coating of the running disk. The aspect ratio was therefore approximately 0.0006. Despite the smaller percentage contact area in example 3 relative to example 2, owing to the large extents of the elevations and depressions a somewhat higher friction results (breaking-away of the cooling lubricant support film). With an aspect ratio of approximately 0.0006, the coating from example 3 is also already close to the limits of the preferred range (0.0004 to 0.4), in the vicinity of which a transition takes place from a friction that is still low according to the invention to a friction that is high in a manner no longer according to the invention.

In comparative example 2, use was made of a running disk coated in an unstructured fashion over the whole area with high thickness uniformity (approximately 90% percentage contact area of the coated area). It therefore corresponded to the illustration in FIG. 6 (A). In contrast to comparative example 1, the running disk was coated by means of a spraying method in comparative example 2, wherein the layer was implemented by the application of many individual, very thin layers and respective flashing-off and curing before the next layer application, thus resulting in a highly thickness-homogeneous layer stack without layer flow as a result of surface tension, for example.

The same PU material as in comparative example 2 was used in comparative example 3. However, a significantly smaller area of the running disk was coated (corresponding to FIG. 6 (B)) by virtue of the fact that the total area of the coating 28 was reduced and the coating 28 was additionally subdivided into four non-continuous regions. By virtue of the smaller total contact area, the friction is reduced somewhat relative to comparative example 2.

Examples 2 and 3 and comparative examples 2 and 3 show that, besides the percentage contact area, in particular the absolute size of the elevations and depressions and also the aspect ratio thereof are essential for a surface of the running disks that exhibits the least possible wet sliding friction.

In comparative example 4, the running disk was only partly coated in accordance with FIG. 6 (C). FIG. 6 (C) shows a core 20 having a non-continuously partial-area coating 29. The partial coating was implemented by methods according to the prior art by the masking of a plurality of regions during the coating process and subsequent removal of the masking, as is described for example in WO 2008/064158 A1. This resulted in a partial coating in the form of a multiplicity of non-continuous individual regions. The experiments could not be finished since layer detachments from the running disk coated in this way and fracture of the semiconductor wafers processed in this way already occurred during the first processing pass.

Since it had been observed that the layer failure (delamination) occurs preferably at the interface between the layer or the layer stack composed of PU useful layer and, if appropriate, further adhesion-promoting intermediate and primer layers and the running disk core, the detachment can be explained by the in total very long exposed edge line of the non-continuous coating segments, which supplies many points of attack. Although this comparative example of a running disk coated with a small percentage contact area yields a removal-rate-related torque <M*>/<dR/dt> comparable with that of the running disk in example 2, owing to the instability of the coating and the constant damage to the semiconductor wafers processed in this way, the running disk according to comparative example 4 is unsuitable for carrying out the PPG processing method.

Further Exemplary Embodiments

FIG. 7 shows further exemplary embodiments of running disks according to the invention:

FIG. 7 (A) has already been explained in connection with example 1.

FIG. 7 (B) shows a running disk with a partial-area coating having continuous elevations 31 and depressions 30 according to an embodiment of the invention. On account of the partial-area coating, there are regions 32 remaining free in which the core 20 of the running disk remains visible, but cannot come into contact with the working layer since the elevations 31 keep the core 20 at a distance from the working layer and the free regions 32 are small enough to counteract the fact that the free regions 32 could deform as far as the working layer on account of the running disk elasticity present owing to the small thickness and finite stiffness of the running disk core 20. On account of the relationship between elevations and depressions, the edge line of the coating is short, and such a running disk according to an embodiment of the invention has very long-lived layer adhesion without partial detachment or semiconductor wafer fracture.

FIG. 7 (C) shows a running disk with a coating that is continuous over the whole area, in which front- and rear-side layers are additionally continuous since they were led through the openings 21 for receiving the semiconductor wafer and the compensation openings 25 for the passage of cooling lubricant and were connected. Such an "all-round" coating has particularly long-lived layer adhesion since an edge line exists only along the omitted region between tooth tips and root circle of the outer toothing.

Leading the coating round through the openings of the running disk and connecting the front- and rear-side layers also makes it possible, given appropriate embodiment, to replace the "insert" 24 (see e.g. FIG. 7 (B)), which prevents contact of the semiconductor wafer with the hard material of the running disk core 20 (avoiding damage to the semiconductor wafer as a result of mechanical action, for example material sapling in the edge region, or as a result of metal contamination of the semiconductor material), completely by the coating 34 (FIG. 7 (C)). Such a running disk is constructed in a particularly simple manner and can therefore be produced particularly economically.

Finally, FIG. 7 (D) shows a running disk with a coating that is continuous over the whole area, having a particularly low percentage contact area (few small elevations 31, separated from one another by wide depressions 30). Despite the small percentage contact area, the coating is embodied as continuous (no separated partial layer regions) according to an embodiment of the invention.

Further embodiments according to embodiments of the invention are shown in FIG. 8:

FIG. 8 (A) shows a running disk in plan view with running disk core 20, opening 21 for receiving a semiconductor wafer, outer toothing 22, dovetail 23 for the positively locking connection of plastic insert 24 and core 20, compensation openings 25 for the passage of the cooling lubricant, and a continuous whole-area coating (apart from the omitted region of the outer toothing 22) having depressions 30, which do not come into contact with the working layer of the processing apparatus for the semiconductor wafers, and elevations 31, which come into contact with the working layer. In the exemplary embodiment shown, the elevations have a circular base area having a diameter of 8 mm and are arranged hexagonally. The shortest distance (minimum width of the depression) between adjacent elevations is approximately 3.4 mm, and the correlation length is 5.2 mm. The percentage contact area of the surface thus coated is 40%.

Upon embodying such a running disk for receiving at least one 300 mm semiconductor wafer (thickness of the semiconductor wafer after grinding approximately 820 μm), the total thickness of the running disk is approximately 800 μm. Of that at least 600 μm is allotted to the core composed of hardened steel in order that the latter has a sufficient stiffness, and therefore a maximum of 100 μm per side is allotted to the coating. Of the 100 μm, if appropriate 10 μm is allotted to an optional adhesive intermediate layer and therefore 90 to 100 μm is allotted to the actual useful layer. In order to obtain a sufficient adhesive strength and tearing resistance, the continuous portion of the layer has a thickness of at least 10 μm. The height of the elevations above the depressions is therefore allotted, finally, approximately 70 to 80 μm per side of the coating. Therefore, the aspect ratio of a coating according to the example shown in FIG. 8 (A) is approximately 0.014. With the layer thicknesses indicated, FIG. 8 therefore shows an exemplary embodiment of a coating in the particularly preferred range for the aspect ratio (0.004 to 0.1).

FIG. 8 (B) shows an enlarged cross section through the coated running disk along sectional line 35 in FIG. 8 (A).

A further exemplary embodiment of a running disk in plan view with a coating that is not over the whole area but is continuous according to the invention is shown in FIG. 8 (C). Regions 32 around all the openings in the running disk core 20 (receiving openings 21 for the semiconductor wafers with dovetail 23 and insert 24 and also passage openings 25 for cooling lubricant) were not coated. The region of the outer toothing 22 was, as always preferred, likewise left free again. The elevations 31 are present as a continuous square grid having a shortest width of the elevations of 2.7 mm. The depressions 30 are rectangular depressions having an edge length of approximately 6.2 mm and an area of approximately 40 mm2, which are completely surrounded by elevations 31. The correlation length is approximately 4.5 mm in this case. The percentage contact area of the coating is somewhat above 50%. The aspect ratio is approximately 0.017 given the same layer thickness difference between elevations and depressions (approximately 75 μm) as described above for FIG. 8 (A). With the layer thicknesses indicated, FIG. 8 (B) therefore likewise shows an exemplary embodiment of a coating in the particularly preferred range for the aspect ratio (0.004 to 0.1).

FIG. 8 (D) shows an enlarged cross section through the coated running disk along sectional line 36 in FIG. 8 (C).

While the invention has been particularly shown and described with reference to preferred embodiments thereof, it will be understood by those skilled in the art that various changes in form and details may be made therein without departing from the spirit and scope of the invention.

LIST OF REFERENCE SYMBOLS

1 Idling torque of the upper working disk
2 Idling torque of the lower working disk
3 Idling torque of the inner pin wheel
4 Idling torque of the outer pin wheel
5 Torque of the upper working disk
6 Torque of the lower working disk
7 Torque of the inner pin wheel
8 Torque of the outer pin wheel
9 Bearing force of the upper working disk
10 Residual removal
11 Force-related net torque of the upper working disk for a comparative example not according to the invention
12 Force-related net torque of the lower working disk for a comparative example not according to the invention
13 Force-related net torque of the upper working disk for an example according to the invention
14 Force-related net torque of the lower working disk for an example according to the invention
20 Core (first material) of an insert carrier (running disk)
21 Opening for receiving a semiconductor wafer
22 Outer toothing
23 Dovetail toothing
24 Lining ("insert")
25 Compensation opening (cooling lubricant passage)
26 Sectional line through running disk
27 Whole-area coating (comparative example)
28 Non-continuously partial-area coating
29 Partial-area, non-continuously segmented coating
30 Depression of a continuous coating
31 Elevation of a continuous coating
32 Free area of a continuously partial-area coating
33 Coating bonded on the front and rear sides
34 Coating bonded on the front and rear sides which replaces the lining of the opening ("insert")
35 Sectional line through coated running disk (type 1)
36 Sectional line through coated running disk (type 2)
<dR/dt> Average removal rate (averaged derivative of the residual removal with respect to time)
F Bearing force of the upper working disk (grinding force)
L Rated power of a main drive
M1 Torque of the upper working disk
M2 Torque of the lower working disk
M3 Torque of the inner pin wheel
M4 Torque of the outer pin wheel
M10 Idling torque of the upper working disk
M20 Idling torque of the lower working disk
M30 Idling torque of the inner pin wheel
M40 Idling torque of the outer pin wheel
<M*> Average net torque of the working disks
M1* Net torque of the upper working disk
M2* Net torque of the lower working disk
n1 Rotational speed of the upper working disk
n2 Rotational speed of the lower working disk
n3 Rotational speed of the inner pin wheel
n4 Rotational speed of the outer pin wheel
PU Polyurethane
R Residual removal
RIM Reaction Injection Molding (molding with curing in the mold)
RPM Rotations (revolutions) per minute
T Time $\Delta\Omega$ Deviation of the working disk rotational speeds from the average rotational speed $\sigma 0$ Rotational speed of the revolution of the running disk midpoints about the midpoint of the processing apparatus in the spatially fixed reference system $\omega 0$ Rotational speed of the inherent rotation of the running disks about their respective midpoints in the spatially fixed reference system $\Omega$ Average rotational speed of the working disks relative to the midpoints of the revolving running disks

What is claimed is:

1. An insert carrier configured to receive at least one semiconductor wafer for double-side processing of the wafer between two working disks of a lapping, grinding or polishing process, the insert carrier comprising:

a core including a first material and having a first surface and a second surface;

at least one opening configured to receive a semiconductor wafer; and a coating at least partially covering the first and second surfaces of the core, the coating including a surface remote from the core that includes a structuring including a multiplicity of elevations and depressions distributed in a pattern across the coating such that a correlation length of the elevations and depressions is in a range of 0.5 mm to 25 mm, and wherein an aspect ratio of the structuring is in a range of 0.0004 to 0.4.

2. The insert carrier as recited in claim 1, wherein the first material is a metal and the second material is a plastic.

3. The insert carrier as recited in claim 1, wherein the coating covers each of the first and second surfaces of the core in the form of one continuous layer.

4. The insert carrier as recited in claim 1, wherein the elevations constitute between 5% and 80% of a total area of the coating.

5. The insert carrier as recited in claim 1, wherein the correlation length of the elevations and depressions of the structuring is in a range of 1 mm to 10 mm.

6. The insert carrier as recited in claim 1, wherein aspect ratio of the structuring is in a range of 0.004 to 0.1.

7. The insert carrier as recited in claim 1, further comprising a third material extending continuously from the first surface of the core through at least one of the at least one opening to the second surface of the core.

8. The insert carrier as recited in claim 7, wherein the third material extends through each of the at least one opening from the first surface of the core to the second surface of the core and completely lines a wall area of each of the at least one opening.

9. The insert carrier as recited in claim 8, wherein the third material is identical to the second material and forms a continuous layer with the second material.

10. A method of simultaneous double-side material-removing processing of at least one semiconductor wafer, the method comprising:

providing a lapping, grinding or polishing apparatus with two rotating working disks;

disposing an insert carrier in a working gap formed between the working disks, the insert carrier comprising:

a core including a first material and having a first surface and a second surface, at least one opening configured to receive a semiconductor wafer, and a coating at least partially covering the first and second surfaces of the core, the coating including a surface remote from the core that includes a structuring including a multiplicity of elevations and depressions distributed in a pattern across the coating such that a correlation length of the elevations and depressions is in a range of 0.5 mm to 25 mm, and wherein an aspect ratio of the structuring being in a range of 0.0004 to 0.4;

disposing each of the at least one semiconductor wafer in a respective one of the at least one opening; and rotating the working disks so as to move the semiconductor wafer under pressure in the working gap formed between the working disks and such that each of the elevations come into contact with one of the working disks and the core and the depressions of the coating do not come into contact with the working disks.

11. The method as recited in claim 10, wherein each working disk includes a working layer containing bonded abrasive, and further comprising feeding a cooling lubricant free of abrasive into the working gap.

12. The method as recited in claim 10, wherein the working disks are circular and wherein the method uses a single insert carrier that covers the entire working disk, the method including driving the insert carrier with eccentrically rotating guide rollers disposed at a circumference of the working disk so as to impart an orbital movement of the insert carrier so as to maintain a respective stationary area under each semiconductor wafer that is continuously completely covered by the respective semiconductor wafer.

13. The method as recited in claim 10, wherein the working disks are ring shaped and the method includes the use of three insert carriers each including an opening for receiving a respective semiconductor wafer, each insert carrier having an outer toothing so as to revolve with inherent rotation about a rotation axis in coordination with a rolling apparatus including an inner pin wheel and an outer pin wheel disposed concentrically with respect to the rotation axis of the working disks and the toothing.

* * * * *